US008347778B2

(12) United States Patent
Caldwell et al.

(10) Patent No.: US 8,347,778 B2
(45) Date of Patent: Jan. 8, 2013

(54) FLUID-WORKING MACHINES

(75) Inventors: Niall James Caldwell, Edinburgh (GB); William Hugh Salvin Rampen, Edinburgh (GB)

(73) Assignee: Artemis Intelligent Power Limited, Edinburgh (GB)

( * ) Notice: Subject to any disclaimer, the term of this patent is extended or adjusted under 35 U.S.C. 154(b) by 717 days.

(21) Appl. No.: 11/910,815

(22) PCT Filed: Apr. 13, 2006

(86) PCT No.: PCT/GB2006/001366

§ 371 (c)(1), (2), (4) Date: Oct. 5, 2007

(87) PCT Pub. No.: WO2006/109079

PCT Pub. Date: Oct. 19, 2006

(65) Prior Publication Data

US 2008/0206073 A1 Aug. 28, 2008

(30) Foreign Application Priority Data

Apr. 15, 2005 (GB) ..... 0507662.5

(51) Int. Cl.
*F01B 1/00* (2006.01)

(52) U.S. Cl. ..... 91/481; 91/478; 91/476; 91/492; 91/491

(58) Field of Classification Search ..... 417/269, 417/270, 273, 298, 247, 264, 405, 347–348; 91/478, 480, 476, 481, 473, 486, 489, 491–492, 91/497–498

See application file for complete search history.

(56) References Cited

U.S. PATENT DOCUMENTS 3,827,338 A * 8/1974 Oguni et al. ..... 91/491
6,293,253 B1 9/2001 Arnold et al.

FOREIGN PATENT DOCUMENTS

| | | | |
|---|---|---|---|
| FR | 2292854 | | 6/1976 |
| GB | 1125562 | | 8/1968 |
| GB | 1299442 | | 12/1972 |
| GB | 1355777 | | 6/1974 |
| JP | 47-20610 | | 7/1972 |
| JP | 2000136775 | * | 5/2000 |
| WO | 91/05163 | | 4/1991 |

OTHER PUBLICATIONS

Machine translation of JP-2000-136775.*
Japanese Official Action issued in JP 2008-505963 on Sep. 6, 2011 and translation.

* cited by examiner

*Primary Examiner* — Charles Freay
*Assistant Examiner* — Christopher Bobish
(74) *Attorney, Agent, or Firm* — Stephen H. Eland; Dann, Dorfman, Herrell & Skillman

(57) ABSTRACT

A fluid-working machine comprises at least one primary working chamber such as a cylinder (4) of cyclically changing volume and primary valves (7) to control the connection of the at least one chamber to low (10)- and high (9)-pressure manifolds. The machine has at least one secondary working chamber (5) of cyclically changing volume and a secondary valve (12, 21) for placing the secondary chamber in communication with the primary chamber (4) in an active state of the secondary chamber (5) and for isolating it therefrom in an idling state of the secondary chamber.

15 Claims, 2 Drawing Sheets

FLUID-WORKING MACHINES

PRIORITY APPLICATIONS

This application is a 371 application of International Application No. PCT/GB2006/001366 filed Apr. 13, 2006, which claims priority to United Kingdom Patent Application No. 0507662.5 filed Apr. 15, 2005. Each of the foregoing applications is hereby incorporated herein by reference.

This invention relates to a fluid driven motor and/or a fluid-driving pump (the motor or pump is called a "fluid-working machine" in this specification) having working chambers of cyclically changing volume and valve means to control the connection of each chamber to low- and high-pressure manifolds. The invention also relates to a method of operating the machine.

The invention has particular reference to non-compressible fluids, but its use with gases is not ruled out. It has particular reference to machines where the at least one working chamber comprises a cylinder in which a piston is arranged to reciprocate, but its use with at least one chamber delimited by a flexible diaphragm or a rotary piston is not ruled out.

WO 91/05163 describes a fluid-working machine having a plurality of cylinders. Electromagnetically actuatable face-seating poppet valves are used to select a different number of cylinders in order to vary the output power.

When fluid-working machines are used in combination to form a variable-speed drive for an application that requires a wide operating speed range, it is difficult to provide sufficient fluid-powered motor displacement volume for low-speed, maximum-torque operation. Previously this problem has been addressed in one of three ways: a very large variable capacity motor has been used, a two-speed gearbox has been inserted into the drive train between the motor and the output, or additional fluid-power machines have been ganged, or brought into service, to increase the effective displacement.

Each of these approaches has its disadvantages and limitations. The very large variable capacity motor spends much of its working life at a small fraction of its maximum capacity, where it runs inefficiently. The gearbox adds a major extra component and thus adds significant weight, with the problem of backlash also being introduced. The gearbox also needs to be taken off-load in order to shift between ratios. Adding additional hydraulic units requires a significantly more complex fluid circuit, with additional switching valves. The additional units may also suffer from the complexity of clutches used to disconnect the additional motors when they are not in use, so as to eliminate parasitic idle loss.

It is therefore an aim of the invention to provide a machine that addresses the disadvantages of these known approaches.

The present invention provides a fluid-working machine comprising at least one primary working chamber of cyclically changing volume and primary valves to control the connection of the at least one chamber to low- and high-pressure manifolds, characterised by at least one secondary working chamber of cyclically changing volume and a secondary valve for placing the secondary chamber in communication with the primary chamber in an active state of the secondary chamber and for isolating it therefrom in an idling state of the secondary chamber.

The at least one secondary working chamber is preferably connected only to the said at least one primary chamber. When the primary and secondary chambers are in communication the working volume of the working chambers is increased, the displacement and torque being increased at lower shaft speeds. There may be one secondary working chamber for each primary chamber. Alternatively, there may be fewer than one secondary chamber for each primary chamber, or there may be tertiary and possibly quaternary etc. chambers, connected with the secondary chambers via valves in series or parallel to the primary chambers.

The primary and secondary chambers may comprise cylinders arranged radially around a crankshaft, and having pistons connected to the crankshaft for rotation thereof.

The secondary valve can be controlled by an electromagnetic, hydraulic, pneumatic or electromechanical actuator.

Secondary valve biasing means such as a spring may be provided for biasing the secondary valve to the closed condition in which the primary and secondary chambers are isolated from each other. The secondary valve may be controlled via a rod which may extend through the secondary chamber. A force-transmitting member may be arranged to move a valve member (of which member the rod may form part) of the secondary valve via an energy storage device, for example a spring. This is useful if the force-transmitting member happens to be actuated at a point in the cycle when the pressure in the primary chamber is high. In an embodiment of the machine, one force-transmitting member is arranged to actuate a valve member of a plurality of secondary valves. The force-transmitting member may comprise a ring extending around the machine.

In a particular embodiment of the inventive machine, the primary valves comprise face-seating valves such as the poppet valves described in WO 91/05163. Alternatively, commutating port valves could be used.

In addition to the connection and disconnection between the primary and secondary chambers, the primary valves may be operable to select or deselect each primary chamber depending the required output of the machine, as described in WO 91/05163.

In order that the invention may be more readily understood, reference will now be made, by way of example only, to the accompanying drawings in which:

FIG. 1 shows a machine comprising a plurality of cylinders, four of which are shown. In this type of machine, the cylinders are arranged radially around an eccentric of a crankshaft 1, but the invention is not restricted to such machines.

Figure 1:
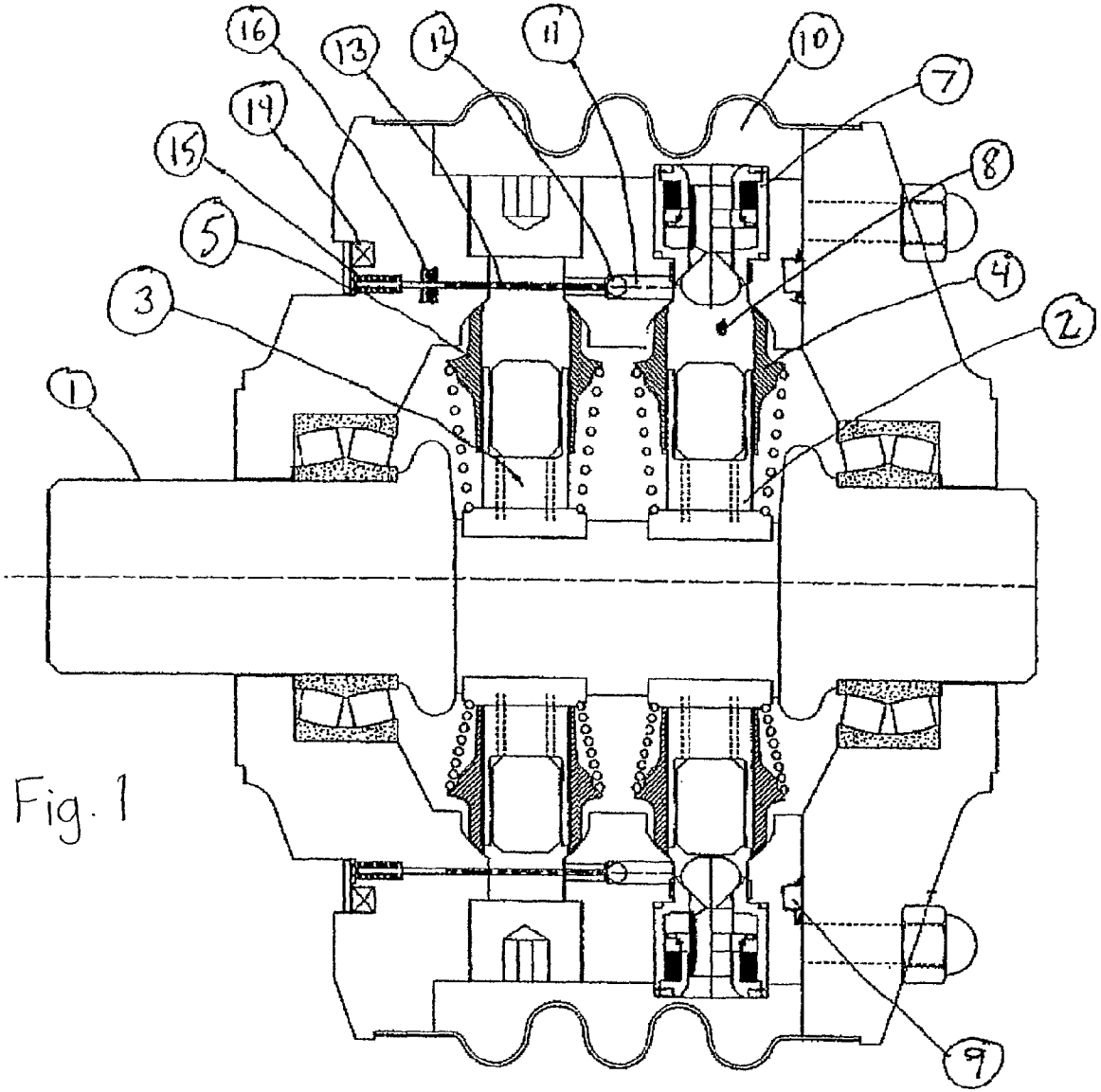
FIG. 1 is a schematic sectional view of a hydraulic motor according to the invention.

Primary cylinders 4 are arranged as follows. In the side wall of each cylinder 4 is a primary poppet valve (not shown, since it is not in the section plane) communicating with a high-pressure manifold 9 and in the end wall of each cylinder 4 is a further primary poppet valve 7 communicating with a low-pressure manifold 10. The poppet valves are active electromagnetic valves controlled electrically by a microprocessor controller.

Pistons 2 act on the crankshaft 1. The controller receives inputs from a shaft encoder, a pressure transducer, and a desired output speed demand signal.

The primary poppet valves seal the respective primary cylinders 4 from the respective manifolds 9, 10 by engagement of an annular valve part with an annular valve seat, a solenoid being provided to magnetically move each said valve part relative to its seat by reacting with ferromagnetic material on the said poppet valve, each said poppet valve having a stem and an enlarged head, the annular valve part being provided on the head and the ferromagnetic material being provided on the stem.

Secondary cylinders 5 are arranged substantially in a plane with each secondary cylinder adjacent its associated primary cylinder 4. The working volume of each secondary cylinder 5 is connected to that of the adjacent primary cylinder via a passageway 11.

Figure 2:
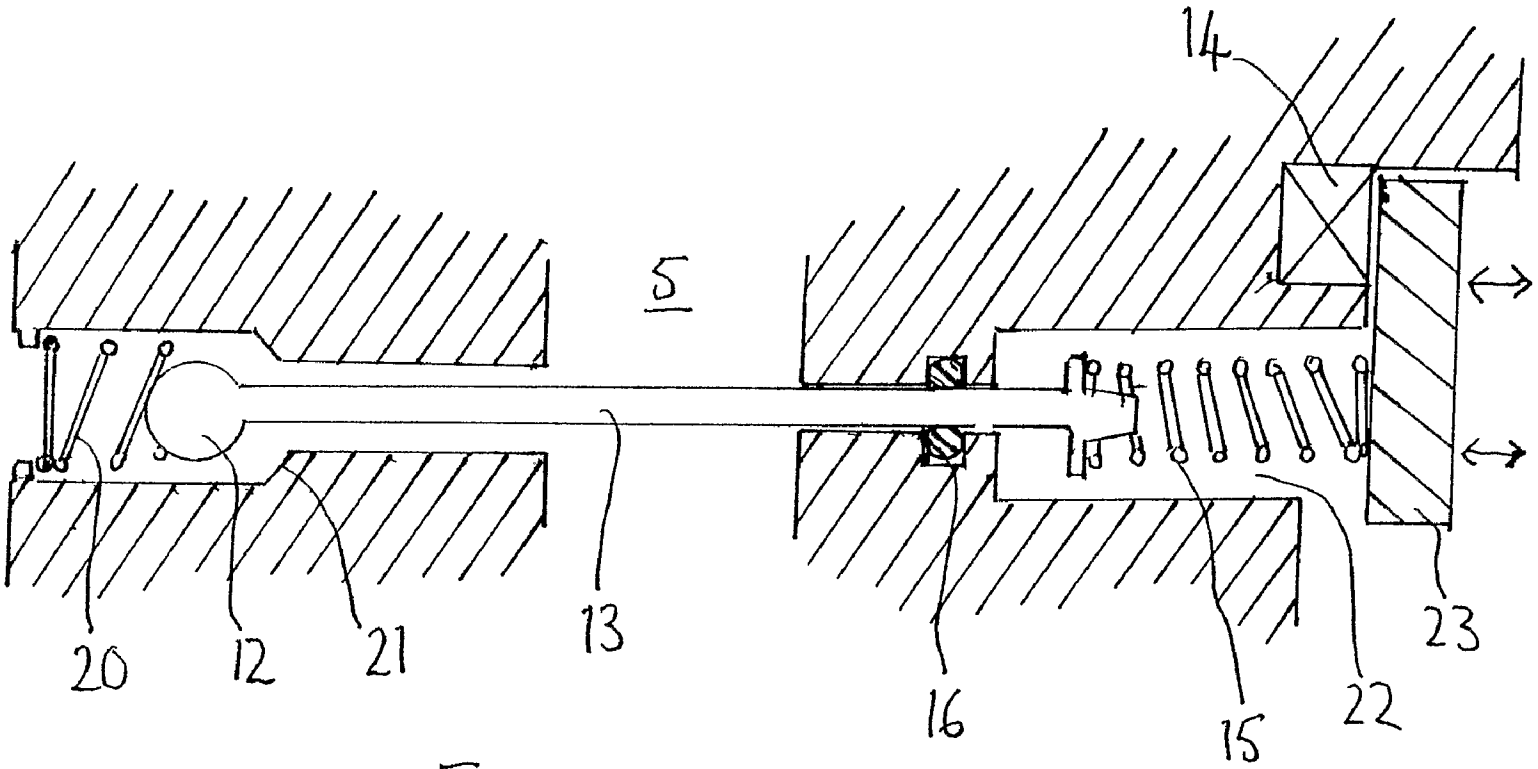
FIG. 2 is an enlarged schematic sectional view of a secondary valve and associated components of the machine of FIG. 1.

As shown more clearly in FIG. 2, a secondary valve comprising a valve member in the form of a ball 12 is located in the passageway 11. A secondary valve spring 20 urges the ball 12 towards a taper 21 in the passageway. The ball 12 is connected to a rod 13 which extends along the passageway 11 as far as a recess 22 into which recess the passageway opens out. A seal 16, provided around the rod between the secondary cylinder 5 and the recess 22, isolates the pressurised secondary chamber 5. The end of the rod 13 is connected to one end of an actuating spring 15 located in the recess. The actuating spring 15 is stiffer than the secondary valve spring 20. The other end of the actuating spring 15 abuts an actuating ring 23 which extends around the machine and comprises ferromagnetic material. A coil 14 also extends around the machine at a different axial position from that of the ring 23.

The machine has one passageway 11 containing a secondary valve for each pair of cylinders 4, 5, each actuating spring 15 being connected to the actuating ring 23.

When the secondary valves are closed only the primary cylinders 4 operate. At low speed, in order to generate higher torque in the crankshaft 1, a current is applied to the coil 14. This moves the ring 23 towards the coil 14, which forces the actuating springs 15 towards the secondary valves. If the pressure in a given primary cylinder 4 is sufficiently low, the secondary valve opens against the action of the secondary valve spring 20, connecting the primary and secondary cylinders so that both are now driven by the pressurised fluid. On the other hand, if the primary cylinder 4 is at a point in its cycle where the pressure is high, the secondary valve cannot open, ball 12 and rod 13 remaining in a position to the right of that shown in FIG. 2, and the actuating spring 15 is compressed. As soon as a point of sufficiently low pressure is reached, the actuating spring 15 opens the secondary valve to the position shown in FIG. 2.

In the position of FIG. 2, the force of the secondary valve spring 20 combined with fluid flow forces on the ball 12 is insufficient to compress the actuating spring 15. Thus the secondary valves remain open until the current to the coil 14 is stopped, whereupon the secondary valve springs 20 close the secondary valves. This allows the machine to operate with less fluid displacement at a higher speed.

The secondary valves could be actuated by a pneumatic or hydraulic actuator instead of the solenoid comprising coil 14 and ring 23. In this regard, a single gallery could communicate with all of the recesses 22 and could be pressurised to open and close the valves when required.

The invention claimed is:

1. A fluid-working machine comprising at least one primary working chamber of cyclically changing volume and primary valves to control the connection of the at least one primary chamber to low- and high-pressure manifolds, at least one secondary working chamber of cyclically changing volume, arranged to communicate with said low- and high-pressure manifolds via said at least one primary working chamber, under active control by a secondary valve for placing the secondary chamber in direct communication with the primary chamber in an active state of the secondary chamber and for isolating it directly therefrom in an idling state of the secondary chamber.

2. A machine according to claim 1, comprising one secondary working chamber for each primary chamber.

3. A machine according to claim 1, comprising tertiary chambers, connected to the primary chambers via valves in series with or in parallel with the secondary chambers.

4. A machine according to claim 1, wherein the primary and secondary chambers comprise cylinders arranged radially around a crankshaft, and having pistons connected to the crankshaft for rotation thereof.

5. A machine according to claim 1, including a secondary valve biasing element for biasing the at least one secondary valve to the closed condition in which the primary and secondary chambers are isolated from each other.

6. A machine according to claim 1, wherein the at least one secondary valve is controlled via a rod extending through the secondary chamber.

7. A machine according to claim 1, wherein a force-transmitting member is arranged to move a valve member of the at least one secondary valve via an energy storage device.

8. A machine according to claim 7, wherein the energy storage device comprises a spring.

9. A machine according to claim 1, wherein one force-transmitting member is arranged to actuate a valve member of each of a plurality of secondary valves.

10. A machine according to claim 9, wherein the force-transmitting member comprises a ring extending around the machine.

11. A machine according to claim 1, including an electromagnetic actuator for actuating the at least one secondary valve.

12. A machine according to claims 11, wherein the actuator comprises a force-transmitting member of ferromagnetic material, and a coil extending around the machine.

13. A machine according to claim 1, including a fluidic actuator for actuating the at least one secondary valve.

14. A machine according to claim 1, wherein the primary valves comprise face-seating valves.

15. A machine according to claim 1, wherein the primary valves are operable to select or deselect each primary chamber depending the required output of the machine.

* * * * *